United States Patent [19]

Maillefer et al.

[11] 3,941,329

[45] Mar. 2, 1976

[54] WINDING APPARATUS

[75] Inventors: Charles E. Maillefer, Renens; Rene Schlaeppi, Prilly, both of Switzerland

[73] Assignee: Maillefer S.A., Switzerland

[22] Filed: Feb. 4, 1975

[21] Appl. No.: 546,945

[30] Foreign Application Priority Data

Feb. 19, 1974 Switzerland ..... 2297/74
July 4, 1974 Switzerland ..... 9173/74

[52] U.S. Cl. ..... 242/80
[51] Int. Cl.[2] ..... B21C 47/00
[58] Field of Search ..... 242/80, 81, 78, 78.3, 25 R, 242/25 A, 54 R

[56] References Cited

UNITED STATES PATENTS 2,944,755 7/1960 Foster ..... 242/80
3,223,345 12/1965 Hill ..... 242/80
3,704,839 12/1972 Manoogian ..... 242/80

FOREIGN PATENTS OR APPLICATIONS 821,666 11/1951 Germany ..... 242/80

*Primary Examiner*—Stanley N. Gilreath
*Assistant Examiner*—John M. Jillions
*Attorney, Agent, or Firm*—Stevens, Davis, Miller & Mosher

[57] ABSTRACT

This invention relates to an apparatus for winding a cable or a flexible tube on winding supports mounted on winding-machines, the apparatus comprising at least two winding supports, a guiding and shearing mechanism having at least one exit opening, and driving means, the guiding and shearing mechanism being disposed facing the winding supports, and the driving means being adapted to advance the cable or tube towards the guiding and shearing mechanism.

12 Claims, 10 Drawing Figures

WINDING APPARATUS

Winding apparatus of this kind are used to wind heavy cables or plastic tubes, either so as to form coils on the winding supports which are a permanent part of the apparatus, or on drums which are then transported to the place where the cable or tube is to be used and then returned once empty to be rewound. In most cases, winding is regulated by a traverse mechanism which reciprocates parallel to the axis of the drum so as to distribute the turns regularly on the winding support. In such apparatus, the provision of two winding supports in front of each guiding and shearing mechanism facilitates the removal of the full drums and their replacement by empty drums, thus saving time because the drums can be exchanged or the coil removed while the other winding support is already taking up the cable or tube. The main advantage of this arrangement is that the production line can work continuously.

However, the previously known apparatus still require intervals of stoppage or slowing down, or else the efforts of numerous personnel, when the cable or tube passes from one winding support to the other. For at the moment when the cable is cut so as to terminate its winding on one of the rotary supports, especially in the case of a thick cable, the new starting end of the cable must be led through the traverse mechanism and fastened to an empty drum or to the coil support, and the winding support must then be started up again. These operations generally require a slowing-down of the production line. In certain cases, accumulators are provided for temporarily storing the cable or tube produced by the line during the time it takes to start up a new drum. However, this solution is expensive and burdensome.

It is the object of this invention to provide a winding apparatus which can work continuously at as uniform a speed as possible, even when the cable or flexible tubes being produced are of relatively large diameter.

To this end, the winding apparatus according to the present invention further comprises a holding mechanism, control means, and, associated with each winding support, a flexible connecting member, a grasping member, and traction means, each grasping member being attached to one end of a respective connecting member, each traction means being adapted to act upon the other end of a connecting member for pulling the respective grasping member towards the associated winding support, the holding means being adapted to hold any one of the grasping members in front of an exit opening, and the control means being adapted to act upon the holding means and the traction means for releasing a grasping member and for setting the respective traction means in motion.

Two possible embodiments of the invention and several variations thereof will now be described in detail with reference to the accompanying drawings, in which.

Figure 3:
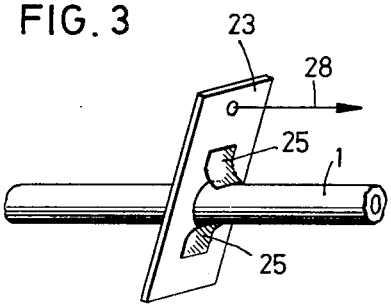
Figure 4:
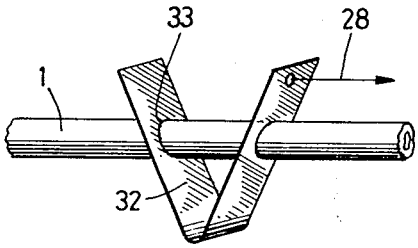
Figure 5:
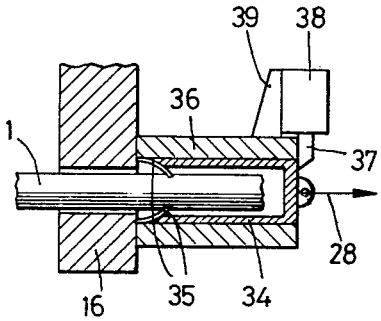
Figure 6:
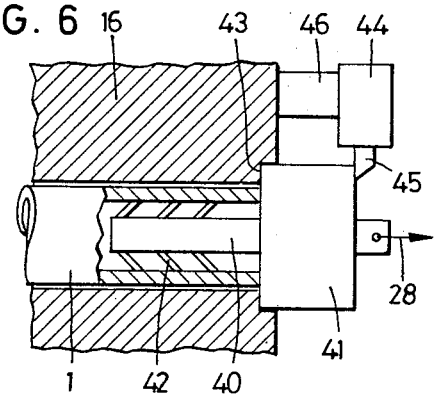
Figure 2:
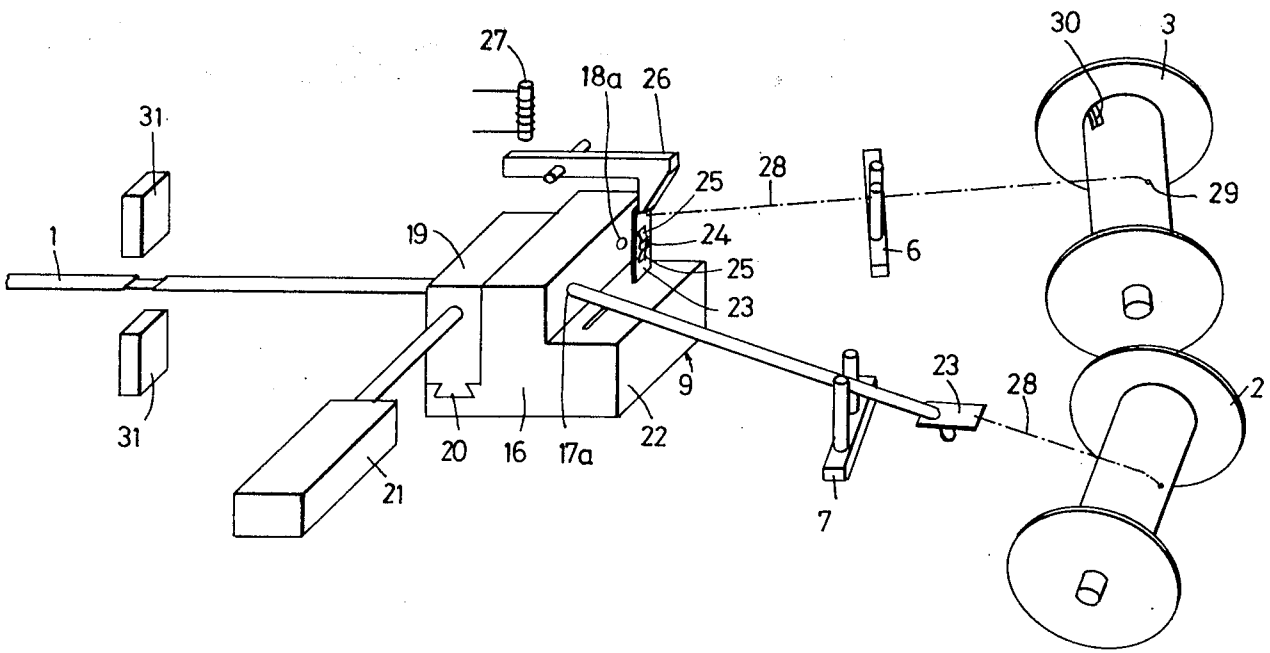
FIG. 2 is a diagrammatic perspective view of the first embodiment.
Figure 7:
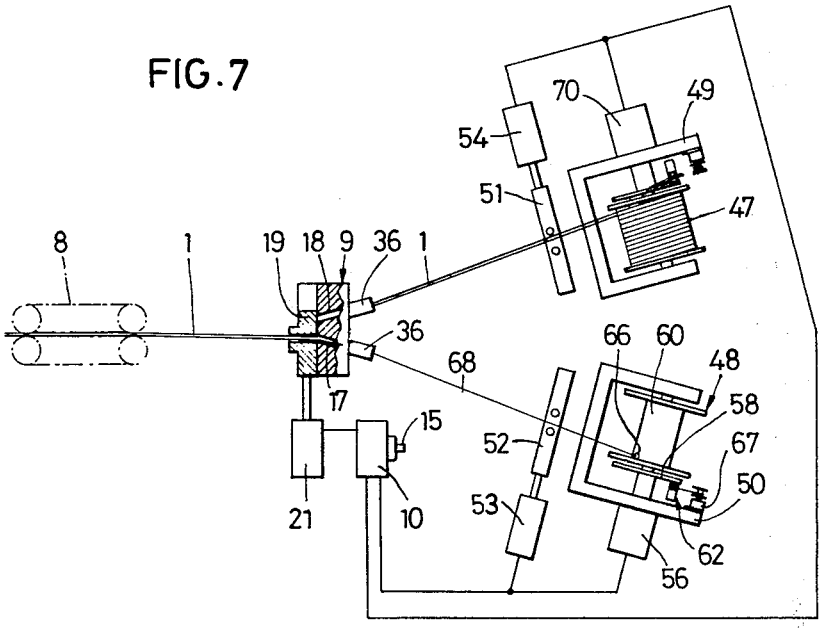
Figure 10:
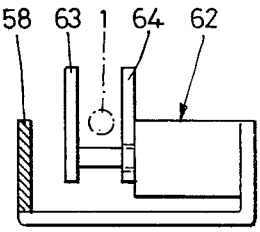
Figure 8:
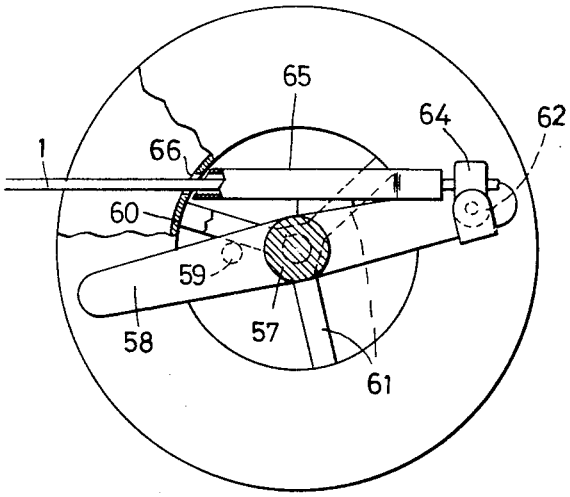
Figure 9:
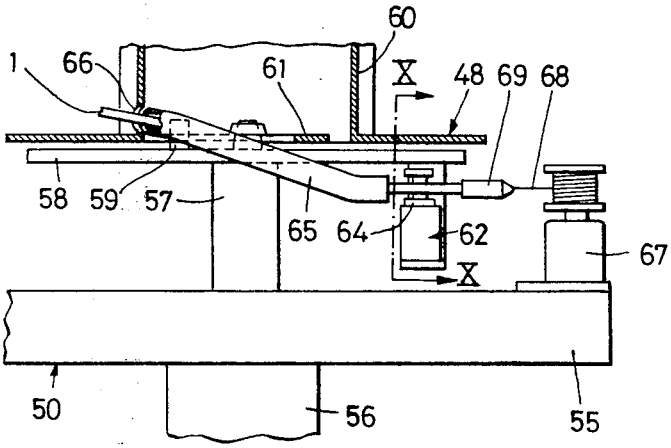

FIGS. 3 and 4 are partial perspective views of variations of the embodiment as shown in FIG. 2, FIGS. 5 and 6 are partial sections of still other variations of the first embodiment, FIG. 7 is a diagrammatic plan view of the second embodiment, FIG. 8 is an elevation, partially cut away, of a drum mounted on a winding-machine, FIG. 9 is a partial section taken on a horizontal plane containing the axis of the winding-machine, and FIG. 10 is a partial section taken on the line X—X of FIG. 9.

Figure 1:
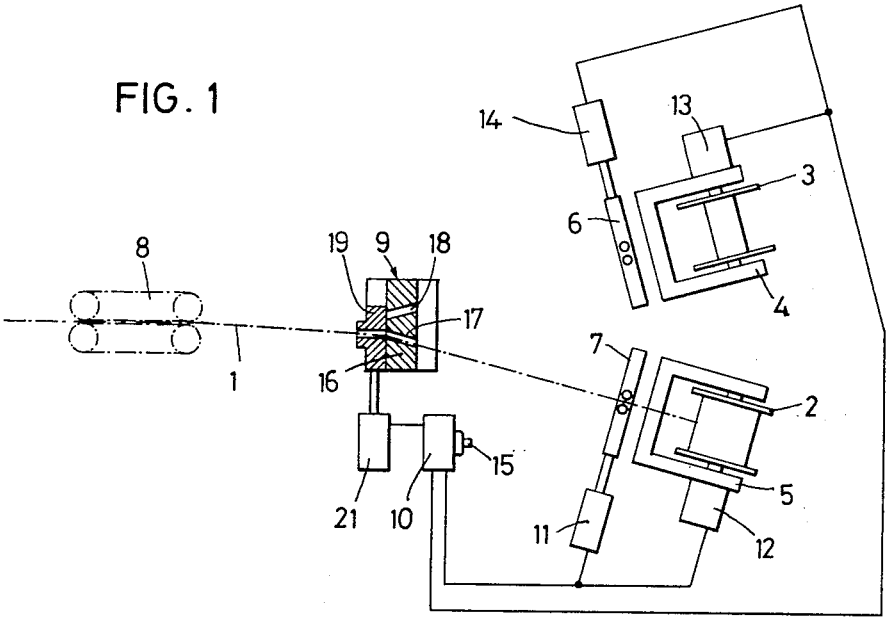
FIG. 1 is a diagrammatic plan view of the first embodiment.

It shall be assumed that the apparatus illustrated by way of example in FIG. 1 is intended for winding a plastic tube 1 about 30 mm. in diameter which is continuously produced by a production line, the details of which need not be described here. The tube 1 moves continuously from left to right as viewed in FIG. 1. It is to be wound in sections of a given length on drums such as drums 2 and 3. For that purpose, two drums are disposed in a manner known per se on two frame elements 4 and 5 equipped with motors 12 and 13 capable of rotating the drums 2 and 3 about their axes. Situated in front of each of the frame elements 4 and 5 is a traverse mechanism 6, 7 for guiding the tube 1 as it is wound on the respective drum so that the turns are laid regularly one beside the other and the several layers are formed regularly.

The tube 1 coming from the production line first passes into a driving device 8 which may, for example, consist of two opposing caterpillar belts or of roller-trains. It then passes into a shearing and guiding mechanism 9, which will be described in more detail in connection with FIG. 2. It will be seen from FIG. 1 that the tube 1 passes through a slanting passage 17 in the mechanism 9 so as to be directed between the two parallel bars of the traverse mechanism 7, then to reach the drum 2. Control elements 10, 11, and 14 are interconnected circuits which make it possible to transfer the tube 1 automatically from the drum 2 to the drum 3. This operation may be controlled by means of a push-button 15, as will be seen further on.

In order to understand how this transfer is effected, FIGS. 1 and 2 will now be considered, in which the driving device 8, the tube 1, and the shearing and guiding mechanism 9 are to be seen. The mechanism 9 comprises a fixed guide block 16 through which two cylindrical passages 17 and 18 run at an angle to one another. A switching block 19 is mounted on the rear face of the guide block 16. It is guided by a rib engaged in a dovetail slide 20 forming part of a lower extension of the block 16, and it is actuated by a jack 21 so as to reciprocate against the rear face of the block 16. Through the switching block 19 passes a cylindrical passage (not shown) perpendicular to the plane of the block 16 and fitted to the size of the tube 1 so that the portion of the tube 1 which is contained within this passage is kept perpendicular to the block 16. It will be understood, therefore, that if when the drum 2 becomes full, the block 19 is moved towards the passage 18, the tube 1 will be cut off in line with the entry opening of the passage 17, and at the same time the section of the tube 1 which is still behind the guiding mechanism 9 will be moved over opposite the entry opening of the passage 18 by the switching block 19. Since the tube 1 is advancing continuously, it will immediately enter the passage 18 and come out at the front face of the block 16.

FIG. 2 shows a support ledge 22 secured to the lower edge of the block 16. The ledge 22 is adapted to support two rectangular plates, one of which, 23, is shown in FIG. 2. In the plate 23, which is slightly wider than the diameter of the tube 1, is a hole 24 fitted to the diameter of the tube 1 and so positioned that the hole 24 is situated immediately in front of the exit opening 18*a* of the passage 18 when the plate 23 is in place on the ledge 22. The plate 23 is further equipped with two grasping blades 25, the function of which will become apparent further on. It is held in place in front of the block 16 by a pivoted catch 26 which can be moved by an electromagnet 27, shown diagrammatically, against the force of a spring (not shown).

The plate 23 is fastened to the end of a flexible connecting member 28 consisting of a wire or a tape, the other end of which is permanently secured at a point 29 on the barrel of the drum 3. As a variation, the connecting member 28 might be secured instead at some other location on the drum, e.g., against one of its cheeks. It will be noted that when the plate 23 is disposed as shown in FIG. 2, the connecting member 28 passes between the two movable members of the traverse mechanism 6. It will therefore have been necessary, when the drum 3 was set in place, to pull the wire 28 and the grasping member, i.e., the plate 23, through the traverse mechanism 6, then to set the plate 23 on the ledge 22 and fix it there by means of the catch 26. The apparatus having been prepared in this manner, the transfer of the winding may be carried out virtually automatically. When the drum 2 is full, it suffices to cause the block 19 to move in the slide 20. The tube 1 is then cut off flush with the rear face of the block 16, and the portion of the tube 1 which is at that moment engaged in the block 19 will be moved over in front of the passage 18. Continuing to advance, this cut portion of the tube 1 enters the passage 18, then passes through the hole 24 in the plate 23. At that moment, the drum 3 is set in rotation, and the plate 23 is released by means of the electromagnet 27 which causes the catch 26 to pivot. The end of the tube 1 is then grasped by the resilient blades 25 of the plate 23, so that the connecting member 28 pulls it towards the drum 3. The member 28 will start to wind up gradually on the barrel of the drum 3. The traverse mechanism 6 being set in motion, the turns will be distributed between the securing point 29 and one of the cheeks, e.g., the one shown at the top right of FIG. 2. At that located, the barrel of the drum 3 has a recess 30 intended to receive the plate 23. As soon as the member 28 is completely wound on the barrel of the drum 3, the winding of the tube 1 may commence and continue regularly until the drum 3 is full. While the drum is starting up, the part of the tube 1 which has already passed through the block 16 will be slightly relaxed, but adjustment of the winding-speed makes it possible to restore running conditions where the drum turns at the same speed as the caterpillar belt 8.

When the drum 3 is full, the return of the block 19 to the positon shown in FIg. 2 will cause the shearing of the tube 1 and its orientation towards a new plate 23 which will meanwhile have been placed in front of the opening 17*a* of the passage 17 and which will be connected to a new drum.

The circuit elements 10–14 shown in FIG. 1 represent a diagram of the control elements which are necessary in order that all the operations described may be carried out sequentially, without further intervention. The push-button 15, which in an automatic installation might be replaced by a running-length counter, triggers the entire cycle of operations. The circuit element 10 represents the control of the electromagnet 27, which is actuated slightly later than the switching block 19. Starting from the circuit element 10, the triggering order is likewise transmitted either to the circuit elements which control the motor 12 of the drum 2 and the traverse mechanism 7, or to the circuit elements which control the motor 13 of the drum 3 and the traverse mechanism 6. Thus a single command triggers the entire cycle of operations. It suffices for the circuit element 10 to comprise an emitter which transmits each order coming from the push-button 15 alternately to the one circuit (12 and 11) and to the other (14 and 15).

Also shown in FIG. 2 is an auxiliary device which may be used when the product to be wound on the drums is a plastic tube. It consists of a clamp 31 which may be operated at the moment when the tube is to be cut and which squeezes the tube together and simultaneously seals it off near the cut end so that this free end of the tube is closed. The entire clamp 31 assembly may be movable in translation with the tube if the operation it carries out takes an appreciable amount of time. Where the product to be wound is a cable, such a clamp is not necessary.

It should also be noted that the guiding and shearing mechanism might equally well be designed differently from what is shown in the drawing. If need be, the shearing of the tube might be carried out at the location occupied by the clamp 31 in FIG. 2, e.g., by means of a circular saw having its axis parallel to the direction of travel of the tube. This saw might also move along with the tube during the cutting operation. In this case, the block 19 would serve only to guide the forward end of the section of cable to be wound on the empty drum, leading it to the entry opening of the corresponding passage.

In the embodiment illustrated in FIG. 2, the grasping member is a rectangular plate 23, and the flexible connecting member 28 is secured to one end of that plate. FIG. 3 shows how the plate 23 is pulled by the connecting member 28 and the way in which the blades 25 penetrate the surface of the tube 1 during the grasping operation. However, other designs of the grasping member are also conceivable. FIG. 4 shows a grasping member which consists of a V-shaped bent resilient blade 32, each arm of which has a hole 33 through which the tube 1 may pass. The connecting member 28 is secured to the free end of one of the arms of the bent blade 32. As long as the blade 32 is held by the catch 26 and supported by the ledge 22, it is kept bent, with its two arms lying flat against one another. As soon as the catch 26 is operated, the front arm springs forward so that the blade 32 grasps the tube 1 by an arching effect.

FIG. 5 shows a grasping member which takes the form of a cylindrical receptacle 34 having near its mouth a resilient washer 35 of a curved conical shape, divided into blades. The bottom of this grasping member will be attached to the connecting member 28 and supported by one of two tubular sleeve elements 36 secured to the front face of the block 16 coaxially with the passages 17 and 18. The grasping member will be held in place by a catch-bolt 37 secured to the end of the rod of a small pneumatic jack mounted by means of a support 39 on each of the sleeve elements 36. The signal for the grasping member to be released will cause the catch-bolt 37 to be raised, thus freeing the receptacle 34.

FIG. 6 shows still another design of the grasping member. It is composed of a cylindrical stem 40, one end of which is attacted to the connecting member 28 and bears an adjusting ring 41, the outside diameter of which is slightly greater than that of the tube 1. The stem 40 also bears metal barbs 42 disposed at an angle in arrowhead fashion so as to enter the tube 1 easily but to arch against its inner surface if an effort is made to withdraw the stem 40 from the tube 1. In this variation, the graspng member may be engaged directly in the passage 17 or in the passage 18, according to whether it is connected to the drum 2 or to the drum 3, the exit opening of each passage having a shallow annular undercut 43 (FIG. 6) enabling the stem 40 to be centered. It will be blocked by a small jack 44, the rod 45 of which is bevelled so that the stem 40 may be put in position and is engaged normally on the front face of the ring 41. The jack 44 will be secured to the block 16 by a rigid support 46.

The apparatus described above makes it possible, thanks to the control circuits shown in FIG. 1, automatically to start up all the operations for accomplishing the transfer, namely, the shearing of the tube and its guidance towards the grasping member connected to the empty drum, the setting in motion of the empty drum and its traverse mechanism, the release of the grasping member, and the stopping of the full drum and its traverse mechanism.

It will be quite obvious, however, that in other embodiments, some of these operations may also be non-automatically controlled by separate control means. Moreover, while the transfer operations have been described taking a plastic tube as an example, it is to be understood that the procedure is exactly the same when the product to be wound is a cable; and that instead of the drums described, the winding supports might equally well consist of cylinders permanently mounted on their supports, the product then being wound in the form of coils which are removed from the cylinder when winding is terminated.

In the various forms of the embodiment described above, the grasping member is a rigid part attached to the flexible connecting member. However, the grasping member might also be designed differently, in the form of a simple loop made at the end of the connecting member. In that case, the connecting member will preferably consist of a cord, and a loop and a clove hitch, for example, may easily be formed near the end of this cord. The end of the cord will be held in a clamp, while the loop will be placed in front of the exit of the passage through which the cable or tube is passing. When the drum is set in motion, the hitch and the loop will be tightened about the end of the cable or tube before the cord is released from the clamp holding it.

The apparatus as described above, however, still presents one drawback when used for winding electric cable. When a drum or coil has been completely wound, the starting end of the cable is buried under the winding and is therefore not accessible. Now in the case of electric cable, it is generally required that both ends of the length of cable wound on a drum be accessible so that electrical measurements for quality-control of the cable can be carried out. The embodiment of the winding apparatus illustrated in FIGS. 7–10 remedies this drawback by making both ends of the cable accessible.

The apparatus as shown in FIG. 7 comprises some of the same parts as shown in FIG. 1. Thus the driving device 8, consisting of a caterpillar belt which advances the cable 1 towards the shearing device 19 controlled by the jack 21, may be seen in FIG. 7. The shearing device 19 directs the cable 1 either towards the passage 17 or towards the passage 18 of the guiding device 9, which carries holding means 36 for grasping members 69 (FIG. 9) intended to draw the end of the cable 1 towards one or the other of two drums 47 or 48 mounted on a winding-machine 49 and a winding-machine 50, respectively. Associated with each of these winding-machines is a traverse mechanism 51, 52. A control device comprising a control circuit 10, driving means 53 and 54 for the traverse mechanisms, driving means 56 and 70 for the drums, as well as other driving means which will be described further on, makes it possible, by operating the button 15, to initiate the carrying out of a programme of operations which is repeated each time the cable 1 is transferred from one drum to the next.

One of the winding-machines is shown in part, but in greater detail, in FIGS. 8 and 9. It comprises a frame 55 bearing the driving motor 56 of a shaft 57. Secured to the end of the shaft 57 is a driving arm 58 equipped with a driving stud 59. The drum 48 mounted on the winding-machine 50 comprises a cylindrical barrel 60 with spoke-wheels 61 placed at each end of it. The end of the shaft 57 is engaged in the central portion of one of the spokes so that when the motor 56 is running, the rotation of the arm 58 causes the drum 48 to rotate. Mounted at one end of the arm 58 is a clamp 62, the body of which is formed by the cylinder of a jack, and the jaws of which are formed by a plate 63 (FIG. 10) integral with the rod of the jack and by a fixed parallel plate 64 mounted on the body of the jack. The control of the clamp 62 is connected to the circuit 10.

The arm 58 also supports a guide-tube 65. This part, consisting of a bent, rigid tube, is secured to the arm 58 in such a way that one end of it is situated immediately in front of the jaws 63, 64 of the clamp 62, while the other end passes between two spokes of the spoke-wheel 61 into the barrel 60 and is situated in immediate proximity to the barrel 60 in the vicinity of one of the cheeks of the drum 48, at a point where the barrel 60 has an opening 66. The guide-tube 65 is intended to guide the cable, but as will be seen later on, it might also be dispensed with in a variation of this embodiment.

The frame 55 of the winding-machine 50 further supports a motor-driven winch 67 on which there is wound a wire or metal traction-cable 68 which constitutes a connecting member between the winding-machine 50 and the guiding device 9. The end opposite the one fixed to the winch 67 has a grasping member 69, which may be snout-shaped, for example, formed of the wires of the cable 68 loosened and spaced from one another.

It will be seen that FIG. 7 shows the positions of the various elements of the apparatus when the drum 47 is practically full and the shearing device 19 has cut off the length of the cable 1 which will form the winding of the drum 47 and has directed the new section of the cable 1 towards the exit opening of the passage 17. This opening, made in the holding member 36, is oriented towards the drum 48. FIG. 9, on the other hand, illustrates the positions of the elements of the apparatus at the moment when the clamp 62 of the winding-machine 50 is about to seize the new section of the cable 1. In the preparatory position of the winding-machine 50 shown in FIG. 7, the cable 68 has been unrolled from the winch 67, led between the jaws of the clamp 62, into the guide-tube 65, through the opening 66 in the drum 48, and between the guides of the traverse mechanism 52, and the grasping member 69 has been engaged in the holding member 36. Immediately after the shearing device 19 has been operated by the jack 21, the holding member 36 releases, and the winch 67 is set in motion, the motor 56 remaining temporarily stopped. Thus it is the winch 67 which pulls the new end of the cable 1 through the above-mentioned elements, the drum 48 remaining stationary until the grasping member 69 arrives at the position shown in FIG. 9. At that moment, the clamp 62 is operated, so that the end of the cable 1 becomes integral with the members driving the drum 48. The member 69 may be detached manually or automatically before the motor 56 starts up. However, the apparatus may also be adjusted so that the motor 56 starts up immediately after the clamp 62 has operated, thus tearing off the member 69 and requiring its replacement before the traction-cable 68 is used again. As soon as the motor 56 has started running, the cable 1 winds up on the barrel 60 of the drum 48, but the end of it remains accessible since it is held by the clamp 62.

In a variation of this embodiment, the winch 67 is mounted on the arm 58 in lieu of the clamp 62. With such an arrangement, it is no longer necessary to detach the member 69 or to break the traction-cable 68 when the winding-machine is started up. It suffices to stop the winch 67 as soon as the traction-cable 68 is completely wound up on it and then to set the winding-machine in motion.

The various designs of the grasping member illustrated in FIGS. 3–6 may be used with the apparatus according to FIGS. 7–10. The holding mechanism 36 will be constructed as a function of the shape and arrangement of the grasping members. As has been mentioned earlier, the guide-tube 65 may be entirely eliminated in all cases where the space crossed by the traction-cable 68 between the opening 66 and the clamp 62 or the winch 67 is sufficient to avoid any risk of catching on the spokes of the spoke-wheel or other parts of the apparatus.

The construction of the semiautomatic apparatus described above is very simple. With a limited number of personnel, it enables the production line of a large-diameter electric cable to be kept in the continuous operation, this cable being wound in successive lengths on drums loaded alternately on the winding-machines 49 and 50. What is more, both ends of the cable 1 are accessible on each drum, thus allowing the necessary tests to be carried out.

The apparatus described may be used to wind not only electric cable, but also all kinds of other cable, flexible sections, tubes, or wires of plastic material, etc.

What is claimed is:

1. An apparatus for winding a cable or a flexible tube on winding supports mounted on winding-machines, said apparatus comprising at least two said winding supports, a guiding and shearing mechanism having at least one exit opening, and driving means, said guiding and shearing mechanism being disposed facing said winding supports, and said driving means being adapted to advance said cable or tube towards said guiding and shearing mechanism, further comprising a holding mechanism, control means, and, associated with each said winding support, a flexible connecting member, a grasping member, and traction means, each said grasping member being attached to one end of a respective connecting member, each said traction means being adapted to act upon the other end of a said connecting member for pulling the respective said grasping member towards the associated said winding support, said holding mechanism being adapted to hold any one of said grasping members in front of a said exit opening, and said control means being adapted to act upon said holding mechanism and said traction means for releasing a said grasping member and for setting the respective said traction means in motion.

2. An apparatus in accordance with claim 1, further comprising a running-length counter for measuring the length of said cable or tube wound on each said winding support, wherein said control means are governed by said counter.

3. An apparatus in accordance with claim 1 comprising two said winding supports, wherein said guiding and shearing mechanism comprises a fixed guide block and a movable switching block, said guide block having two transverse passages, each with an entry opening and a said exit opening, said switching block having a central passage and being movable parallel to a face of said guide block between two positions, and said central passage communicating with one of said entry openings in each of said positions.

4. An apparatus in accordance with claim 3, wherein said central passage is fitted to the diameter of said cable or tube, the end of said central passage facing said guide block comprises a sharp edge, and said switching block constitutes a shearing member adapted to cut said cable or tube when moved from one of said two positions to the other.

5. An apparatus in accordance with claim 3, wherein said holding mechanism comprises two support elements and two catches, said support elements being mounted on the side of said guide block remote from said switching block and each being adapted to support a said grasping member in front of a said exit opening, and each of said catches making a said grasping member integral with a respective support element.

6. An apparatus in accordance with claim 5, wherein said control means comprise an electropneumatic jack and an electric switch, said jack being adapted to operate a said catch and being controlled by said switch.

7. An apparatus in accordance with claim 6, wherein said control means further comprise a time delay circuit and a selection circuit, said circuits being adapted to start up each of said traction means alternately with a predetermined delay after the operation of said catch.

8. An apparatus in accordance with claim 1, wherein each said traction means comprises means for attaching said other end of a said connecting member to the associated said winding support and means for rotating said winding support.

9. An apparatus in accordance with claim 1, wherein each said traction means comprises an opening in the associated said winding support and a winch, said opening allowing the passage of a respective said conecting member, said other end of said connecting member is attached to said winch, and said winch is independent of the associated said winding support.

10. An apparatus in accordance with claim 9, wherein said winding supports are removable drums, each said winding-machine comprises a fixed frame and a rotary arm, each said arm being adapted to drive a said drum rotatingly and bearing a clamp, and each said winch is mounted on a said frame near a said arm, each said clamp being connected to said control means by a remote-control connection, and each said connecting member associated with a said grasping member held by said holding mechanism being engaged in a respective clamp.

11. An apparatus in accordance with claim 9, wherein said winding supports are removable drums, each said winding-machine comprises a fixed frame and a rotary arm, each said arm being adapted to drive a said drum rotatingly, and each said winch is mounted on a respective said arm.

12. An apparatus in accordance with claim 9, wherein said winding supports are removable drums, each said winding-machine comprises a fixed frame and a rotary arm, each said arm being adapted to drive a said drum rotatingly and bearing a rigid guide-tube adapted to guide said cable or tube and a respective said connecting member from said opening in the associated said winding support towards a respective said winch.

* * * * *